United States Patent [19]

Bouquet

[11] 4,008,981

[45] Feb. 22, 1977

[54] DEVICE FOR LOCATING THE POSITION OF THE CONTROL RACK OF A PUMP AND FOR LOCKING THE LATTER IN DISASSEMBLING POSITION

[75] Inventor: Jean-Claude Bouquet, Pantin, France

[73] Assignee: Societe d'Etudes de Machines Thermiques, Saint Denis, France

[22] Filed: Mar. 26, 1975

[21] Appl. No.: 562,003

[30] Foreign Application Priority Data

May 17, 1974 France ..... 74.17318

[52] U.S. Cl. ..... 417/63; 417/499; 123/139 AA; 92/128

[51] Int. Cl.² ..... F04B 21/00; F04B 7/04; F04B 39/10

[58] Field of Search ..... 417/63, 454, 499, 494; 92/128; 123/139 AA; 116/124 A, 124 D, 129 M, 125

[56] References Cited

UNITED STATES PATENTS

| | | | |
|---|---|---|---|
| 1,398,256 | 11/1921 | Caracristi | 116/125 |
| 2,309,074 | 1/1943 | Edwards | 417/63 |
| 2,419,818 | 4/1947 | Burton | 116/124 A |
| 2,696,189 | 1/1954 | Born et al. | 116/125 |
| 2,729,168 | 1/1956 | Ziesche et al. | 92/128 |

*Primary Examiner*—Carlton R. Croyle
*Assistant Examiner*—Thomas I. Ross
*Attorney, Agent, or Firm*—Kenyon & Kenyon Reilly Carr & Chapin

[57] ABSTRACT

A variable displacement pump, the delivery of which is controlled through the medium of a toothed rack meshing with a pinion through which the piston of the pump is adapted to slide axially, said piston being adapted to rotate jointly with said pinion and to move in translation jointly with pump actuation means, and the toothed rack meshing with an auxiliary shaft pinion the angular position of which is located by an indicating needle, thus ensuring a measurement of the delivery of said pump.

6 Claims, 7 Drawing Figures

12
11
13
14
15
16
17
18
19
28
29
30
31
32
33
34
40
41
43
44
II
III
IV

DEVICE FOR LOCATING THE POSITION OF THE CONTROL RACK OF A PUMP AND FOR LOCKING THE LATTER IN DISASSEMBLING POSITION

The present invention has essentially for its object a variable-displacement or variable-delivery mechanical pump, e.g. an internal-combustion-engine fuel-injection pump of the type provided with a constant delivery-stroke piston, wherein the pump delivery is adjustable by rotating the piston about its longitudinal centre-line. More specifically, the invention relates to a device for locating the position of a toothed rack serving to adjust the delivery of such a pump by rotating the piston about its longitudinal centre-line, the upper end of the said piston comprising at least one helical ramp communicating selectively with the fuel intake and return orifices, depending upon the angular position of the piston imparted by the said rack. The invention also relates to the use of the said locating device as a locking device allowing the assembled movable parts of the pump to be held in a given angular position for changing the piston and the associated cylinder sleeve or lining through the top of the pump casing.

The variable-displacement pumps and more particularly the injection pumps of the afore-mentioned type are well known in the prior art (See, for example, U.S. Pat. No. 2,309,074 of Jan. 19, 1943) and comprise essentially a piston mounted slidingly in a cylindrical chamber forming the pump casing. The piston moves in front of the fluid intake and return orifices, which may be merged in a single orifice, so as to ensure the delivery of a certain amount of the said fluid by the said piston during reciprocating movements of translation towards a discharge valve. Since the piston stroke is constant within the pump casing, the amount of fluid delivered in each cycle is determined by the angular position of the piston within the said pump casing, which is provided at its upper portion with a lateral recess communicating with the delivery chamber of the pump casing and provided with a helical edge portion moving opposite the fluid intake and return orifices. The position of the said helical edge portion within the pump casing defines the working or delivery stroke of the pump, since in each cycle of the piston the said delivery is discontinued when the said helical edge portion arrives in front of the fluid return orifice. The angular position of the piston within the pump casing is performed by a pinion through which the piston slides axially and which rotates jointly with the latter and by a rack co-operating with the said pinion.

The displacement of the rack, generally controlled by a follow-up system, allows the angular position of the piston and therefore its working or delivery stroke to be adjusted within the pump casing.

It is useful to provide means for displaying in a simple manner the angular position of the said piston within the pump casing. For this purpose, a known system consists of providing external graduations on the rack itself. However, this simple system is not always applicable, since the said rack is often mounted in a place which is difficult of access when the said pump is used for instance as a fuel injection pump in an internal combustion engine; the rack portions which can be provided with the said graduations are most of time concealed by other members of the engine.

With the foregoing in view, the present invention relates more particularly to a variable-displacement pump, e.g. a fuel-injection pump for an internal combustion engine, of the type provided with a constant delivery-stroke piston and including in particular a rack co-operating with a pinion in which the piston slides axially, the said piston being adapted to rotate jointly with the said pinion and to move in translation jointly with the pump actuating means, characterized in that it comprises means for displaying and locating the present amount of fluid delivered in each cycle, comprising an auxiliary shaft pinion so mounted as to rotate about its longitudinal centre-line, meshing with the said rack and the angular position of which is located by an indicating needle moving for instance in front of a graduated sector.

Moreover, a known improvement in a pump of this type is that which consists of causing the piston to rotate jointly with the said pinion and to move in translation jointly with the pump actuating means through the medium of shape-conditioned connections adapted to be eliminated in a given angular position of the assembled movable parts. This improvement allows the piston and the associated cylinder sleeve to be removed directly through the top of the pump casing without dismounting the pump itself, thus resulting in considerable time and labour saving. More specifically, the said given angular position of the assembled movable parts is almost compulsorily situated outside the normal sector of movement of the pinion and this angular position is most often adjacent to one of the end angular positions corresponding to zero delivery or to maximum delivery of the pump. This means that during all the steps of removal of the piston and the cylinder sleeve, the rack must be held in abutment, thus requiring an important effort owing to the presence of return springs tending to permanently move back the said rack to a position corresponding to the mean delivery of the pump.

With the foregoing in view, the invention also has for its object to take advantage of the structure of the aforesaid displaying and locating means to facilitate the manual actuation of the rack and allow it to be locked in a position corresponding to the said given angular position.

More particularly, the invention therefore relates to a variable-displacement pump possessing the afore-mentioned features, characterized in that one of the ends of the shaft of the aforesaid auxiliary shaft pinion is accessible and ends with a driving square allowing the rack to be displaced manually through the medium of the said auxiliary pinion. Moreover, means are provided for locking the said shaft in a predetermined angular position corresponding to the said given angular position of the assembled movable parts, wherein the aforesaid shape-conditioned connections can be eliminated.

The invention will be better understood and other purposes, details and advantages of the latter will appear more clearly from the following explanatory description given solely by way of example with reference to the appended drawings wherein.

Figure 7:
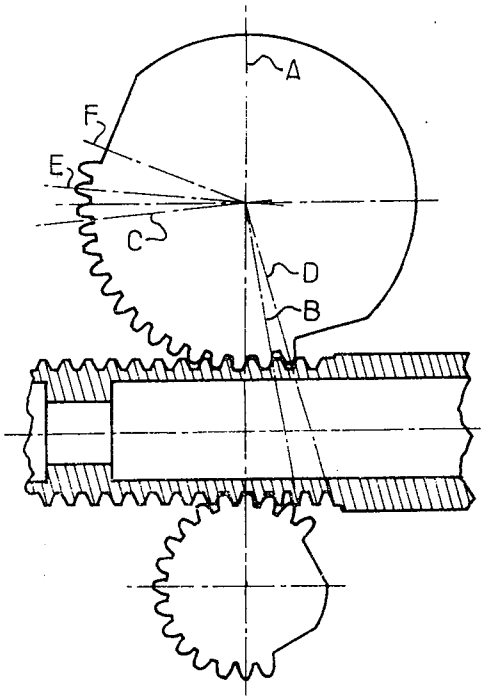
Figure 6:
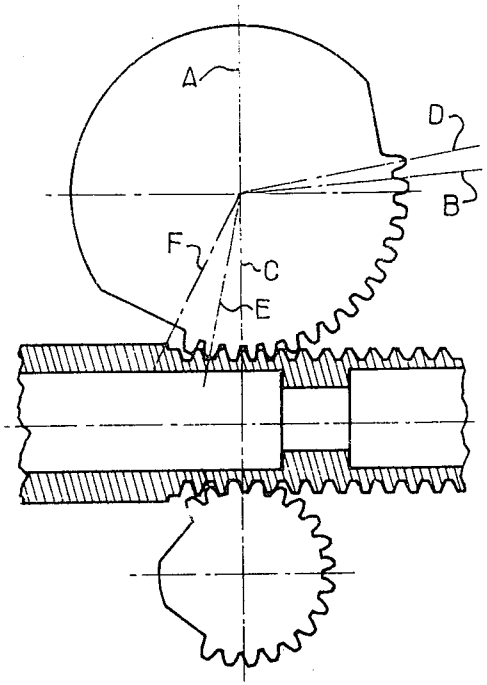
Figure 5:
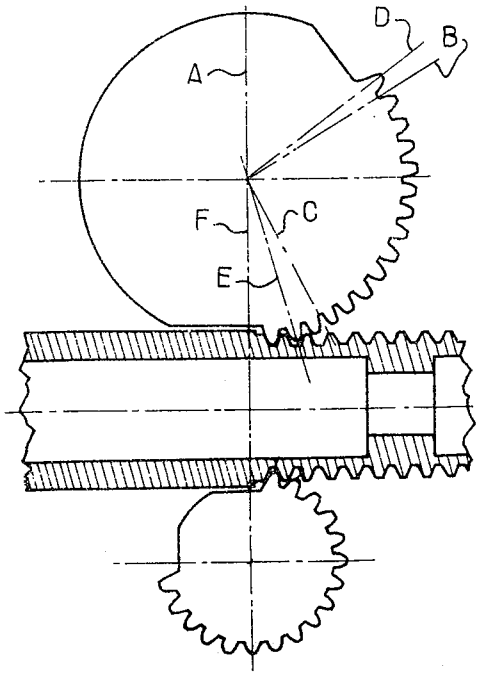

FIGS. 5, 6 and 7 diagrammatically show the two pinions co-operating with the rack in various positions of the latter.

Figure 1:
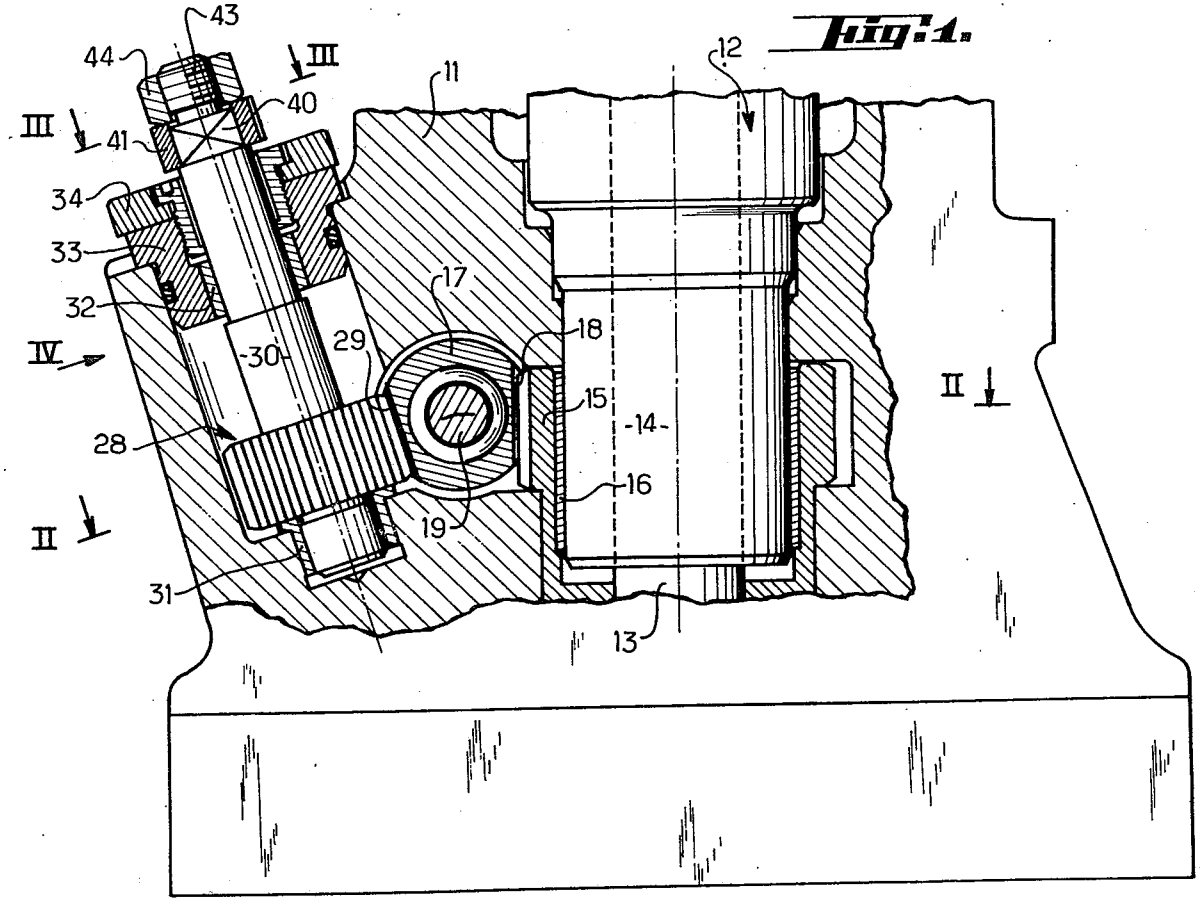
FIG. 1 is a detail view of a pump according to the invention shown partially in section in the medial transverse plane of the pump at right angles to the rack.
Figure 2:
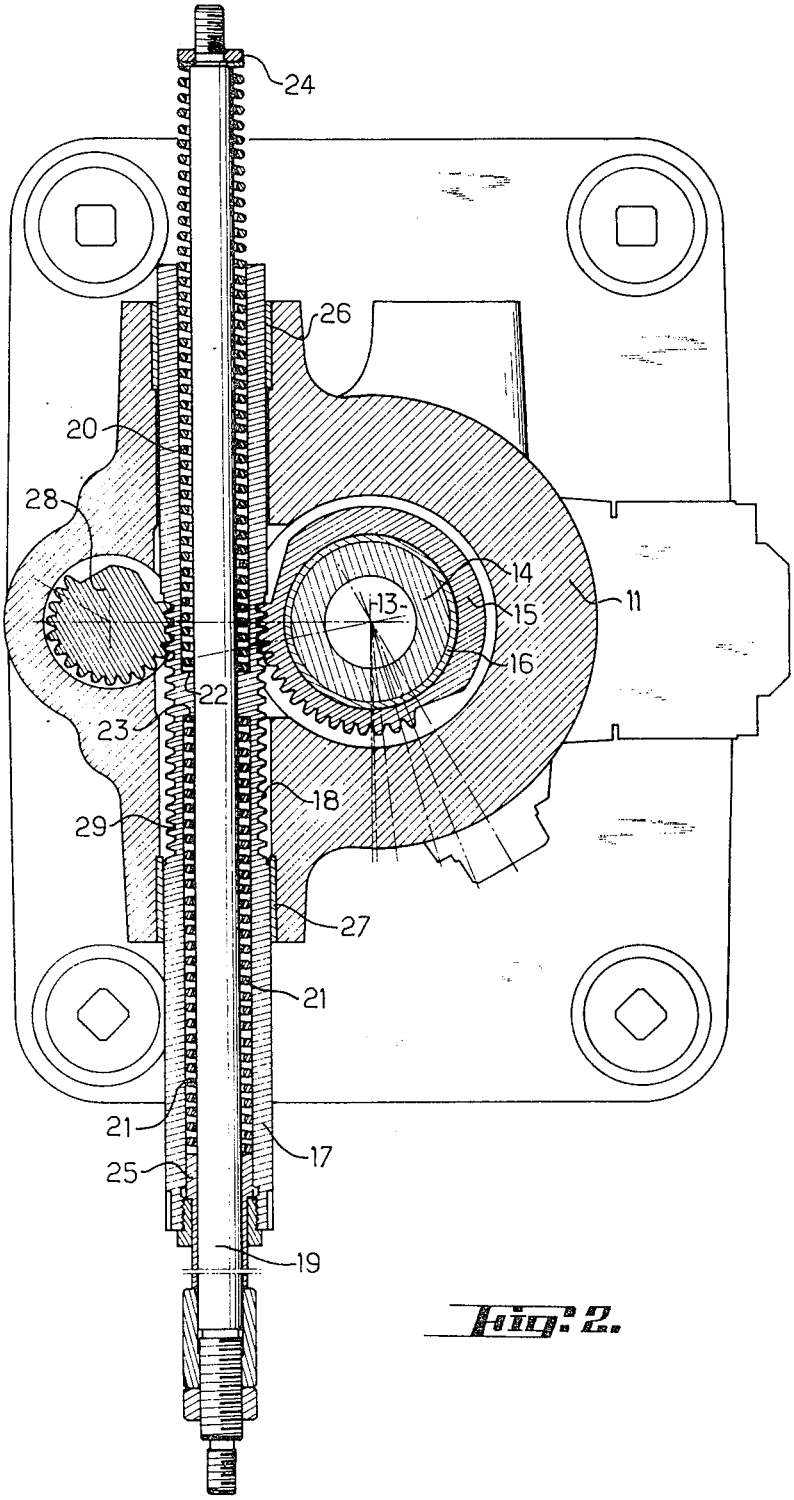
FIG. 2 is a sectional view substantially upon the line II—II of FIG. 1.

In FIGS. 1 and 2 is illustrated a portion of a pump according to the invention, showing the detail of the mechanism allowing the angular position of the piston within the pump casing to be varied.

This pump, whose general features are well known in the art, will be briefly described hereafter in order to facilitate the understanding of the operation of the mechanism according to the invention.

The pump comprises a casing designated by the reference numeral 11 within which is mounted a sleeve or lining 12. The piston 13 normally slides within the sleeve 12 and the external surface of the lower portion 14 of the said sleeve is adapted to guide in rotation a hollow shaft pinion 15 through the medium of a bush 16. The piston 13 and the pinion 15 are adapted to rotate jointly owing to a sliding-key or flat-surface connection (not shown) arranged under the sleeve 12. The hollow pinion 15 co-operates with the rack 17 owing to a toothed portion 18 of the latter. It will be noted that the rack 17 has the general shape of a hollow cylinder driven in translation by an internal control rod 19 and through the medium of antagonistic or mutually opposed compression springs 20 and 21 placed between respective internal shoulders of the rack 22–23 and stops, abutments, rings or collars 24–25, respectively, integral with or secured to the rod 19. This arrangement is advantageous and even indispensable where the control rod 19, which is most often connected to a servo-mechanism permanently determining its position, is used to control several pumps at a time and for instance all the injection pumps of the various cylinders of an internal combustion engine. Indeed, in such a case, the casual jamming, seizing or like failure of a pump in a given position must not disturb the operation of the other pumps through the medium of the common rod 19. Owing to the arrangement just described, each rack is driven through the medium of the springs 20–21, the stiffness of which is sufficient to allow the rack 17 sliding between two bushes 26–27 to accurately follow the displacement of the rod 19 during normal operation. On the other hand, if one of the racks is jammed for any reason whatsoever, the other racks will continue to follow the motions of the rod 19, it being understood that the aforesaid control servo-mechanism has a sufficient actuating force to overcome the opposed forces of the springs 20–21 of the jammed pump.

Figure 4:
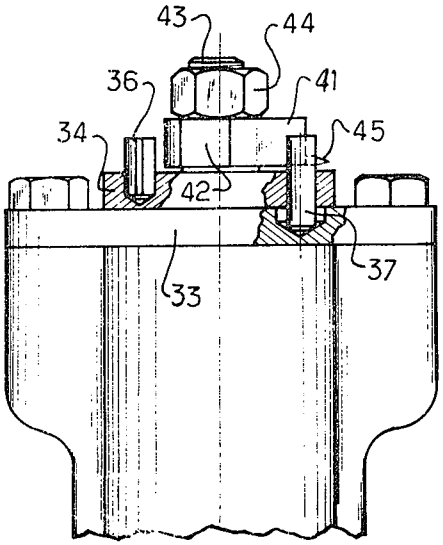
FIG. 4 is a partial side-view, partially broken away, according to arrow IV of FIG. 1.
Figure 3:
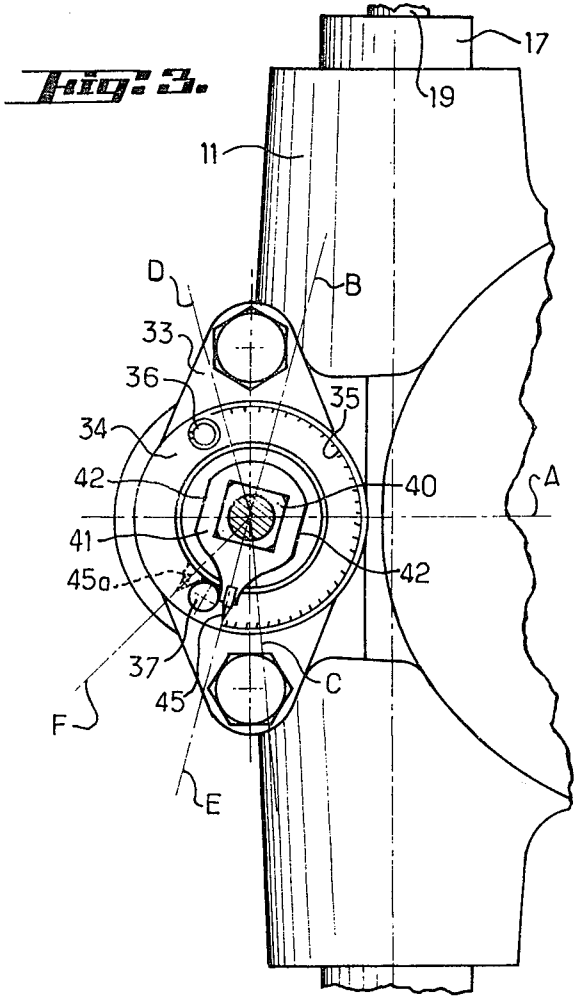
FIG. 3 is a partial sectional view substantially upon the line III—III of FIG. 1.

The improvement according to the present invention, which appears externally more in detail in FIGS. 3 and 4, is essentially constituted by an auxiliary shaft pinion 28 co-operating with the rack 17 owing to an auxiliary toothed portion 29 thereof. The shaft 30 of the auxiliary pinion 28 is guided in rotation by a bush 31 secured in the pump casing and by a bush 32 mounted within a plug member 33 which is itself surmounted by a metal scale member 34, the external radial surface of which is marked with locating graduations 35 arranged between two stops or abutments 36 and 37. The stop 36 is advantageously constituted by a resilient split pin whereas the stop 37 is removable.

It should be noted that the two toothed portions 18 and 29 of the rack 19 are symmetrical with respect to a longitudinal axial plane of the said rack and approximately opposed to one another for the purpose of reducing the risk of deformation of the said rack during the gear-cutting operation.

The shaft 30 is provided at its accessible upper portion with a driving square 40. An indicating needle 45 is adapted to move in front of the graduations 35 and is carried by a metal needle-carrying member 41 which is itself secured to the driving square 40. The member 41 is provided with two flat surfaces 42 allowing the auxiliary pinion 28 and therefore the rack 17 to be actuated manually. The shaft 30 terminates in a threaded portion 43 for a locking nut 44.

Thus, the described mechanism according to the invention permanently allows the instantaneous position of the rack and therefore the present amount of fluid delivered in each cycle of the pump to be permanently located. However, the very structure of this mechanism offers the additional advantage of a facilitated removal of the piston 13 and the sleeve 12 through the top of the pump casing.

Indeed, referring more particularly to FIGS. 3, 5, 6 and 7, several angular positions of the hollow shaft pinion 15 (and therefore the piston 13) are illustrated by dot-and-dash lines. More precisely, the radial direction A serving as a reference, it will be noted that:

B indicates the position corresponding to maximum delivery;

C indicates the position corresponding to zero delivery;

D indicates the locking position between the member 41 and the stop 36;

E indicates the locking position between the member 41 and the removable stop 37;

F indicates the locking position beyond the removable stop 37, corresponding to the given angular position of the assembled movable parts, in which the aforesaid shape-conditioned connections can be eliminated.

Under such conditions, it is seen that FIG. 6 shows a pump in a zero-delivery position, FIG. 7 shows the same pump in a position where the delivery is almost at a maximum, whereas FIG. 5 shows the pump in disassembling position, also indicated in FIG. 3 by the needle 45*a* shown in dotted lines.

It is readily understood that when the operator desires to change the piston 13 and the associated sleeve 12, he momentarily removes the stop 37, moves the member 41 beyond the engraved sector 35 and then puts the stop 37 back to its place, so that, owing to the aforesaid locking, the whole assembly of movable parts is placed in the angular position suitable for carrying out the removal of the piston 13 and the sleeve 12 through the top of the pump casing 11.

The invention therefore simplifies and facilitates a maintenance operation for which it was hitherto necessary to search for the correct angular position by manually pushing or pulling the rod 19 to overcome the force of the springs and to permanently keep the said rod in this position for the duration of the operations.

Of course, the present invention is not at all limited to the form of embodiment which has just been described, which has been given solely by way of example. On the contrary, the invention comprises all the means constituting technical equivalents to the means used if same are used within the scope of the appended claims.

What is claimed is:

1. Variable displacement pump, for use as a fuel injection pump for an internal combustion engine or the like of the type provided with a constant delivery-stroke piston, the angular position of which inside a casing for the pump determines a particular amount of fluid delivered in each cycle, comprising a toothed rack having a toothed portion, a pinion cooperating with said toothed portion through which said piston is adapted to slide axially, said piston being movable in translation jointly with pump actuating means and to rotate jointly with said pinion for varying said angular position and therefore said particular amount; said pump also including means for displaying said particular amount, comprising an auxiliary shaft pinion adapted to rotate about its own longitudinal center-line disposed in meshing relationship with said rack and supporting an indicating needle supported by said last-named pinion, a graduated sector over which said needle is movable; said pump being also of the type wherein at a given angular position of said piston the latter may be removed from the pump casing and whereby one end of said auxiliary shaft pinion is accessible, said end comprising driving square means for enabling said rack to be displaced manually through the medium of said auxiliary shaft pinion.

2. Pump according to claim 1, wherein said needle is directly mounted on said auxiliary shaft pinion through the medium of a needle-carrying member and wherein said needle-carrying member is mounted on said driving square.

3. Pump according to claim 1, including means for locking said auxiliary shaft pinion in a predetermined angular position corresonding to said given angular position of the said pinion.

4. Pump according to claim 2, including means for locking said auxiliary shaft pinion in a predetermined angular position corresponding to a given angular position of the said pinion.

5. Pump according to claim 4, wherein said locking means include said needle-carrying member and comprise in addition a removable or retractable stop, abutment, pin or the like co-operating with said needle-carrying member and so arranged as to keep said needle-carrying device beyond a normal sector of movement with respect to the aforesaid graduated sector, in said predetermined angular position.

6. Pump according to claim 1, wherein the aforesaid auxiliary shaft pinion co-operates with an auxiliary toothed portion of said rack distinct from the aforesaid toothed portion actuating the first-mentioned pinion, said toothed portions being substantially symmetrical with respect to a longitudinal axial plane of said rack and approximately opposed to one another.

* * * * *

UNITED STATES PATENT AND TRADEMARK OFFICE

CERTIFICATE OF CORRECTION

PATENT NO. : 4,008,981

DATED : February 22, 1977

INVENTOR(S) : Jean-Claude Bouquet

It is certified that error appears in the above-identified patent and that said Letters Patent are hereby corrected as shown below:

The correct name of the Assignee is:

Societe d'Etudes de Machines Thermiques-S.E.M.T.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*